United States Patent [19]

Jurinak

[11] Patent Number: 4,700,631

[45] Date of Patent: Oct. 20, 1987

[54] INK FOUNTAIN AND INK FOUNTAIN SUPPORT FOR PRINTING PRESS

[75] Inventor: Edward L. Jurinak, Prospect Heights, Ill.

[73] Assignee: Apollo Labeling Systems, Worth, Ill.

[21] Appl. No.: 739,552

[22] Filed: May 30, 1985

[51] Int. Cl.[4] ..... B41F 31/04; B41F 31/06

[52] U.S. Cl. ..... 101/350

[58] Field of Search ..... 101/350, 363, 364, 351, 101/352, 365, 366, 148, 207-210, 157, 169

[56] References Cited

U.S. PATENT DOCUMENTS

| | | | |
|---|---|---|---|
| 2,232,274 | 2/1941 | Robbins | 101/363 |
| 3,006,275 | 10/1961 | Allen | 101/157 |
| 3,176,611 | 4/1965 | Tripp | 101/364 |
| 3,630,146 | 12/1971 | Shields | 101/366 X |
| 3,800,702 | 4/1974 | Roberts | 101/365 |
| 4,026,210 | 5/1977 | Merzagora | 101/350 |
| 4,373,443 | 2/1983 | Matalia et al. | 101/363 X |
| 4,414,900 | 11/1983 | Kraus et al. | 101/363 |
| 4,481,883 | 11/1984 | Savart et al. | 101/363 |

*Primary Examiner*—J. Reed Fisher

*Attorney, Agent, or Firm*—Norman Lettvin

[57] ABSTRACT

An ink fountain for supplying ink to the ink carrying surface of a printing press form roll has an ink receptacle which may be removed from and reinstalled into the press separate from the adjustable support assembly which maintains it in an operative position with respect to the form roll. The adjustable support assembly enables a doctor blade on the ink receptacle to be placed in an optimum position with respect to the ink carrying surface of the form roll. Dam members which seal front portions of the ink receptacle to the form roll are, in a preferred embodiment, formed as part of the ink receptacle assembly and are removed and reinstalled together with the ink receptacle. The dam members may be formed of a relatively inexpensive, resilient plastic material whereby it is more economic to dispose of them and replace them with new dam members rather than clean them.

19 Claims, 10 Drawing Figures

FIG. 1
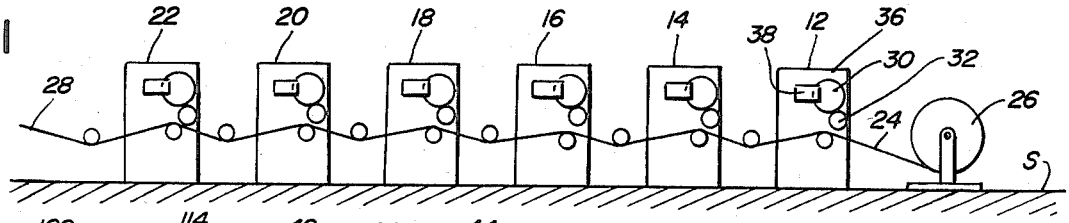
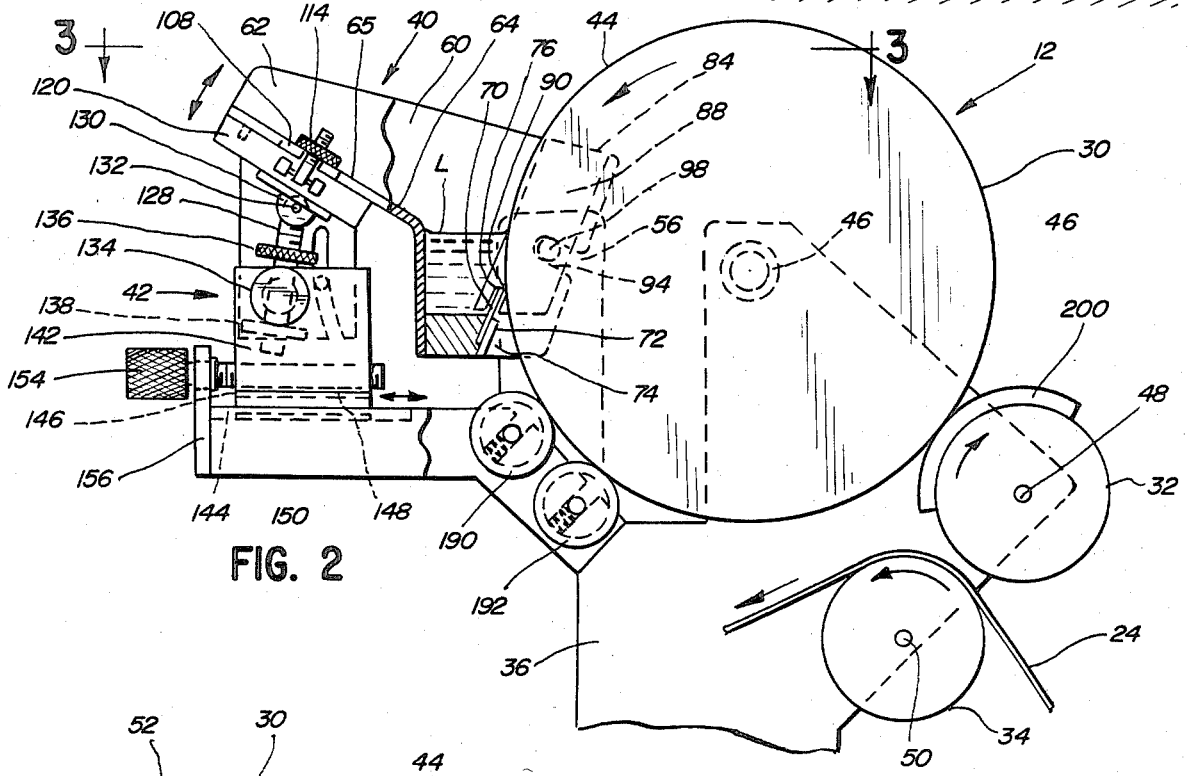
FIG. 2
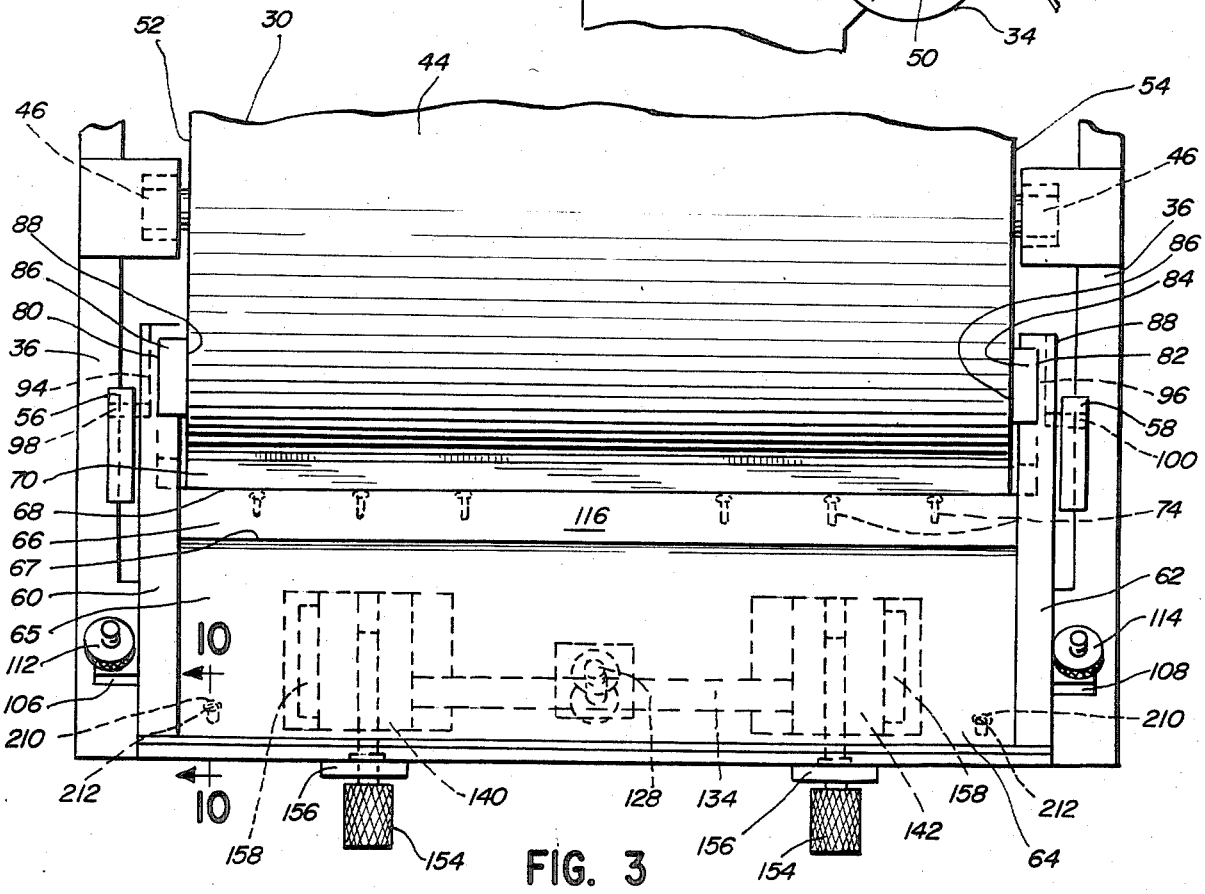
FIG. 3

INK FOUNTAIN AND INK FOUNTAIN SUPPORT FOR PRINTING PRESS

BACKGROUND OF THE INVENTION

1. Field Of The Invention

This invention relates to improvements in ink fountains, of the type having a doctor blade, for supplying ink to an ink carrying roll of a printing press, such as an anilox ink transfer roll of a letter press.

2. Description Of The Prior Art

Ink fountain assemblies for supplying ink to the ink transfer roll of a printing press are old and well known. Also, means for controlling or metering the amount of ink carried from the ink fountain by the ink transfer roll, such as doctor blades, are well known and currently in commercial use.

U.S. Pat. No. 4,432,282 to Jurinak, the inventor of the invention disclosed herein, shows a downwardly depending doctor blade positioned between the front and rear walls of an ink fountain. The doctor blade is vertically adjustable with respect to the surface of the ink transfer roll. This disclosure teaches improvements over the invention disclosed in the inventor's previous patent.

U.S. Pat. No. 4,158,333 to Navi shows a baffled ink fountain having the front wall of the ink fountain formed of a reverse angle doctor blade which contacts the surface of a rotating inking cylinder.

U.S. Pat. No. 4,445,433 to Navi shows an ink fountain similar to that shown in U.S. Pat. No. 4,158,333 to Navi. In each of the patents to Navi the doctor blade is shown engaging a portion of the ink transfer surface of an ink transfer roll located in the lower left quadrant of a counterclockwise rotating transfer roll.

Prior art printing presses, such as offset or letter press printing presses, typically required a cumbersome multiplicity of ink working distribution rolls interposed between the ink transfer roll and the printing or plate roll to evenly distribute ink on the plate roll in an effort to reduce, or preferably, eliminate an undesirable uneveness of printing often referred to as "ghosting."

"Ghosting" is caused by having the ink transfer roll acquire a buildup of ink on a particular portion of its surface which corresponds to a portion of the printed material, such as a non-ink receiving white area defined by being surrounded by a red, or other color, ink, placed on the printed material by the print roll. During rotation of the print and ink transfer rolls, and the ink distributing rolls the ink buildup is transferred back onto the print roll and consequently the printed material has a darker red area which is shifted in position but corresponds in size to the non-ink receiving white area.

It is known that the use of a doctor blade optimally adjusted with respect to the ink carrying surface of the ink transfer roll can substantially eliminate such "ghosting." However, the prior art attempts to accomplish this do not provide the degree of adjustment of the doctor blade with respect to the ink transfer roll to substantially eliminate "ghosting" under virtually all conditions. Also, each time a color is changed, or a repair must be made to an ink fountain, the ink fountain must be removed from the press and, upon its reinstallation, a substantial amount of time and testing is required to again adjust the doctor blade into its optimal relationship or engagement with the roll.

Prior art ink fountains also require that a substantial amount of ink be deposited in them in order to properly wet the ink transfer roll. For short runs of the press where a small quantity of the printed material is to be prepared, the ink remaining in the ink fountain will often be wasted due to being disposed of. Such waste of ink imposes an economic penalty on the printer and/or the purchaser of the material.

None of the above cited patents, nor any other prior art of which Applicant is aware, either singly or when combined, teach or show or suggest the ink fountain assembly disclosed below.

BRIEF SUMMARY OF THE INVENTION

One purpose of the ink fountain assembly disclosed herein is to constantly provide a fresh amount of ink deposited onto the ceramic anilox roll by submersing the ceramic anilox roll into the ink held in the fountain and then blading, or doctoring, off the surface of the ceramic anilox roll by use of a reverse angle doctor blade, thereby leaving ink only in the indentations of the screen of the ceramic anilox roll. This insures leaving only a fresh amount of ink on the ceramic anilox roll devoid of any ghosting from previous contact with the plate roll and ready for new contact with the plate roll with every revolution of the ceramic anilox roll.

The 8 o'clock position of the reverse angle doctor blade, in relation to the ceramic anilox roll, allows for any build up of ink on the backside of the reverse angle doctor blade to fall away, under gravity, from the ceramic anilox roll. This allows the ceramic anilox roll to remain free of any droppings or deposits of ink prior to contact with the plate roll, which then would allow for a clean transfer of ink to the paper, otherwise there would be ink splatters on the final printed image. This system allows for the use of paste type inks with a wide variation in viscosities normally used in offset and letterpress printing. It also does away with the large train of distributor rollers used by other systems for elimination of ghosting and milling of the ink, such as are presently used in all conventional offset and letterpress systems. Also there are no fountain keys to adjust on the fountain, as are used on conventional offset and letterpress systems, thereby providing for much faster set up time and requiring less expertise of the pressman.

The small well at the front base of the fountain provides means for only a small amount of ink to be used, and therefore saves on the amount of ink needed to wet the doctor blade. Either a small or large amount of ink can be used in the fountain disclosed herein. This is important in cost savings and also assures that the reverse angle doctor blade will be completely submerged in ink. If the blade is not always submerged in ink, it can cause ink starving of the reverse angle doctor blade which causes undesirable or unacceptable light speckled spots on the finished printed product.

A proper setting of the reverse angle doctor blade angle against the ceramic anilox roll is made by only one adjustment knob and allows for a minute change in the amount of ink left on the ceramic anilox roll prior to transfer to the plate roll.

The two side pins, that the fountain side dams fit into, along with two recesses coacting with two pins on the fountain and the fountain mounting base, assure exact original positioning of the reverse angle doctor blade, that is attached to the fountain pan, with the ceramic anilox roll after removal of the pan or blade for wash up or blade change.

Gasket or wiper blade inserts in the side dams of the fountain are a throw away item and are provided to obtain a leakproof joint between fountain side dams and the rotating ceramic roll.

One or two oscillating rollers located at positions following and below the reverse angle doctor blade, press against the ceramic anilox roll by friction, thereby eliminating a gear driven mechanism which could cause gear chatter and transfer of light and dark streaks to the printed image on the paper corresponding to the teeth in the gears. They also provide for a smoothiing of the paste type ink on the ceramic anilox roll prior to the ceramic anilox rolls' contact with the plate roll which assures a very smooth lay down of ink on the paper being printed.

The ink fountain assembly for supplying ink to an ink transfer roll of a printing press, such as an anilox roll of a letter press, is comprised of an ink receptacle having an inkwell in which the front wall of the inkwell is defined by a doctor blade. The forward portion of the inkwell is configured to be fully operational with a relatively small quantity of ink.

The ink receptacle is formed as a self-contained unit which may typically be removed from and reinstalled into operative engagement with an ink transfer roll. The ink fountain may be removed and reinstalled into its operative position without need for any adjustment of the relationship between the doctor blade carried by the ink receptacle and the peripheral ink carrying surface of the ink transfer roll contacted by the doctor blade. In one form of the invention disposable side seals or dams are carried directly by the ink receptacle.

As adjustable support means, which enables both angular and radial adjustment of the doctor blade of the receptacle with respect to the ink carrying surface of the ink transfer roll, is provided to supportedly retain the receptacle in a manner which enables the press to be shut down and the ink receptacle be removed from the press to accomplish a necessary task. Washing the receptacle and placing a different color of ink in it or replacing a worn or deformed doctor blade are examples of such necessary tasks.

The receptacle can then be replaced on its adjustable support base in substantially the exact position it was removed from and the press can immediately be returned to production without need of additional time-consuming adjustments.

Additionally, the adjustable support base for the ink containing receptacle provides a single adjustment for changing the angle with which the doctor blade engages the ink carrying surface of the ink transfer roll and a pair of adjustments for controlling or adjusting the pressure with which the doctor blade contacts the radial outward facing ink carrying surface of the ink transfer roll. Thus, if adjustment of the ink transfer roll is desired or required, the adjustment can be readily made.

BRIEF DESCRIPTION OF THE DRAWINGS

FIG. 1 is a diagramatic side elevation view of a plurality of printing press units serially arranged to print a multicolored design on a roll of material and indicating a typical position of an ink fountain assembly in such a printing press unit;

FIG. 2 is an enlarged partially cut away side elevation view of a portion of one of the printing press units shown in FIG. 1, showing the relationship of an ink fountain assembly of this invention with respect to an ink transfer roll of a printing press;

FIG. 3 is a fragmentary top plan view of the ink fountain assembly and portion of the printing press shown in FIG. 2, as indicated by the section line 3—3 in FIG. 2 and rotated 90° counterclockwise;

DETAILED DESCRIPTION OF THE INVENTION

Figure 6:
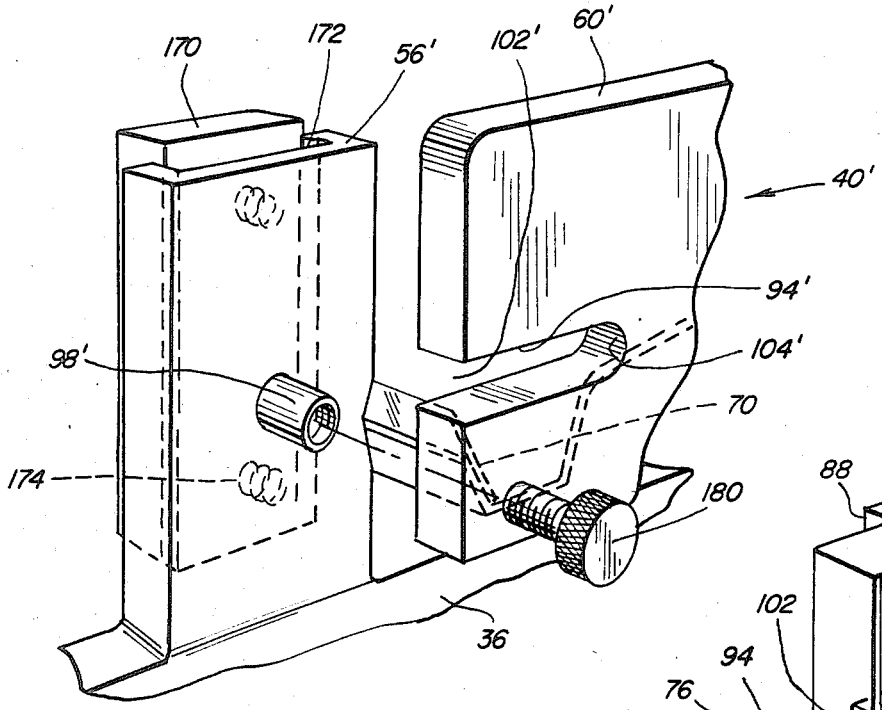
FIG. 6 is an enlarged view, in perspective, illustrating an alternate means for engagement of an ink fountain of this invention with a printing press.

FIG. 1 is a side elevation view diagrammatically showing a plurality of substantially identical printing press assemblies 12, 14, 16, 18, 20 and 22 serially arranged on a suitable support surface S to repetitively print, in a substantially continuous, high volume manner, a multicolored graphic and/or linguistic design and/or message on a continuous strip of suitable printing material, such as a strip of suitable paper 24.

Paper strip 24 is drivingly pulled from a suitable roll 26 by the press assemblies and a different color is normally printed at a precise location on the strip as it is passed through each assembly. At the output end 28 the now printed paper may be fed to suitable machinery (not shown) such as cutting equipment for cutting the printed material into discrete sheets, such as for labels or forms, or rerolled onto another roll for further processing or storage.

Referring to printing press assembly 12 of FIG. 1, each assembly typically is comprised of a well known and commercially used set of rolls consisting of a form roll 30, a plate roll 32 and an impression roll 34. Each of the rolls are substantially cylindrical in shape and are journaled or mounted for rotation on, or with respect to, a suitable portion of a substantially fixed frame, generally designated by reference numeral 36, of the press assembly. A suitable ink fountain or ink receptacle 38 is typically mounted or supported on a suitable portion of frame 36 adjacent the form roll 30 to supply ink to the form roll, which is an ink carrying roll.

Referring to FIGS. 2 and 3, the subject of this invention relates to the structure of a novel ink fountain 40 and a novel adjustable mounting structure 42 for adjustably mounting the ink fountain to the frame 36 in a desired relationship to the peripheral radially outward facing ink carrying surface 44 of the form roll 30.

As shown, each of the cylindrical rolls 30, 32 and 34 are mounted on a respective shaft 46, 48 and 50 each of which is parallel to the longitudinal axis of the roll and is journaled to an appropriate portion of the frame means 36. Each of the rolls normally rotate during operation of the press in the direction indicated by the arrows in FIG. 2.

As best shown in FIG. 3, the form roll 30 having the ink carrying radially outward facing surface 44 has first and second terminal end portions 52 and 54, resectively, which extend from surface 44 to shaft 46 and are positioned substantially normal to the longitudinal axis of the roll 30.

Affixed to frame means 36 longitudinally outboard of each end 52 and 54 of the roll 30 are a pair of pivot brackets 56 and 58, respectively.

Ink fountain structure 40 is comprised of a first side member 60, a second side member 62, an upper bottom portion 64 which extends between laterally spaced side members 60 and 62 and is sealingly engaged with the side members and a lower bottom portion 66 which is sealingly engaged with a forward lower portion of bottom portion 64 and each of the laterally spaced sides 60 and 62. Bottom portion 64 has a sloped portion 65 and a substantially vertical portion 67. Vertical portion 67 is spaced from and substantially parallel to surface 44 upon installation in a press to from a relatively small capacity ink well 116. The front portion of the ink receptacle 40 is considered to be that portion which is, or is adapted to be, positioned adjacent and engaged with the form roll 30. The rear portion is that portion distal the front portion, i.e., substantially that portion having the sloped bottom 65.

Sealingly engaged for selective removal and replacement with a forward portion 68 of lower portion 66 is a doctor blade 70. Doctor blade 70 is removably sealingly engaged to member 66 by appropriate means, such as a retaining bar 72 which is engaged to bottom portion 66 by a plurality of spaced threaded fasteners, such as, for example, machine screws 74. As shown, the doctor blade 70 extends upwardly from member 66 to contact the ink carrying radially outward facing surface 44 of the roll 30. An upper terminal end portion 76 of doctor blade 70 establishes a laterally extending, substantially line contact engagement with surface 44. As best shown in FIG. 3, the doctor blade extends laterally outward of each end 52 and 54 of roll 30 to contact a substantial line portion of the entire longitudinally extending surface 44. Having the surface contacting end portion 76 of the doctor blade 70 extend laterally outward beyond each of the ends 52 and 54 of surface 44 of roll 30 assures no bead or build up of ink will be present on surface 44 of roll 30 during operation of the press.

Figure 4:
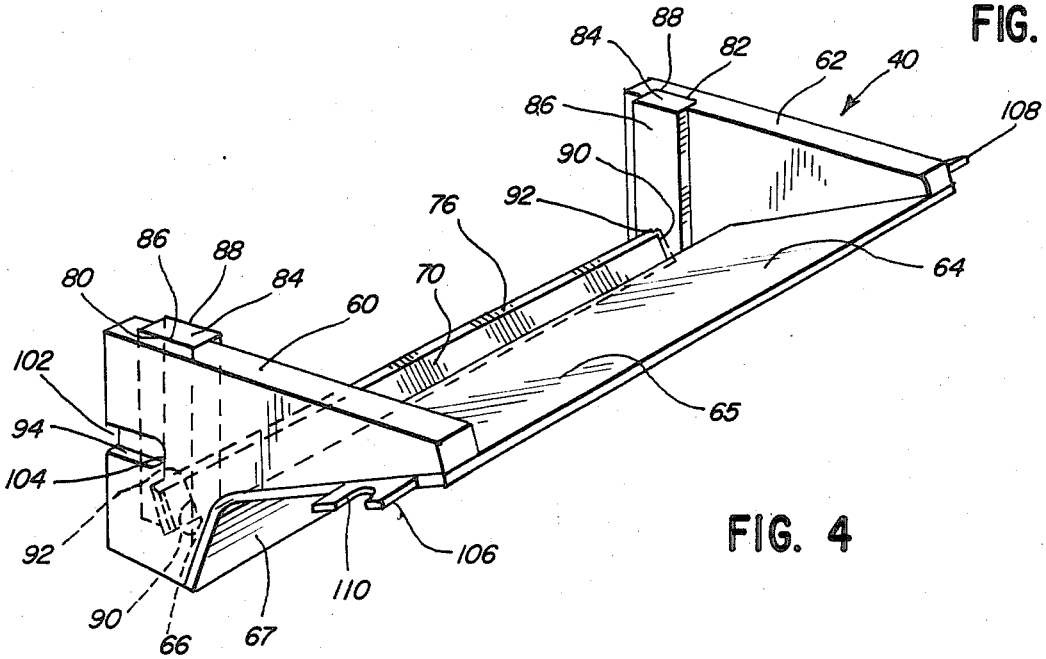
FIG. 4 is a left rear perspective view of an ink fountain of this invention.

Ink fountain assembly 40 is further comprised of means for sealingly engaging the side members 60 and 62 to the respective terminal side surfaces 52 and 54 of the ink carrying roll 30. The sealing means are formed of a pair of substantially vertically extending slots 80 and 82 formed respectively on the inner or opposed side surfaces of a pair of front engagement portions or elements of the side members 60 and 62 of the ink fountain. Each of the slots 80 and 82, which are substantially mirror-images of each other, are constructed to sealingly receive a dam member, such as a resilient dam member 84. Each dam member 84, as best shown in FIGS. 3 and 4, has a first sealing side surface 86, and a second sealing side surface 88. Dam members 84 are preferably formed of a relatively inexpensive plastic material, such as, for example, molded styrofoam, which is substantially dimensionally stable under varying thermal levels and is impervious to fluids.

Each dam member 84 is provided with a doctor blade receiving slot 90. The slot 90 is structured and arranged to receive that portion of each end of the doctor blade 70 which extends laterally beyond the ends 52 and 54 of the ink carrying roll 30. As best shown in FIG. 4, the apex or uppermost portion 92 of the slot 90 in each dam member 84 is sized to sealingly engage a portion of upper terminal end 76 of the doctor blade 70. The members 84 are, as shown, used in both of the retaining slots 80 and 82 of the ink fountain 40.

Figure 5:
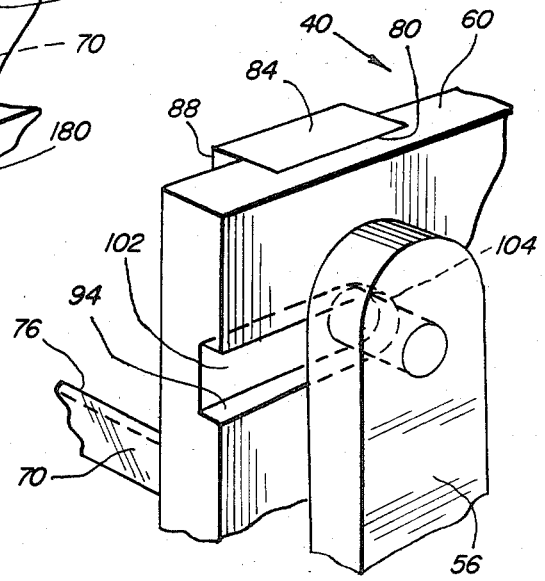
FIG. 5 is a fragmentary perspective view illustrating the slidingly removable and replaceable engagement of the ink fountain shown in FIG. 4 with that portion of the printing press shown in FIGS. 2 and 3.

Ink fountain 40 also has at the leading laterally outer surface portion of each side member 60 and 62 a pivot member receiving means such as elongated slots 94 and 96. A pivot means, such as pivot pin 98 affixed to and extending laterally inward from pivot bracket 56 and pivot pin 100 affixed to and extending laterally inward from pivot bracket 58, as shown in FIG. 3, are positioned to be slidably received, respectively, in slots 94 and 96. As best shown in FIGS. 4 and 5 for slot 94 in side member 60, each of the slots 94 and 96 has a forward open end portion 102 for slidingly receiving the pivot pin 98 shown mounted to pivot bracket 56 in FIG. 5. Each of the slots 94 and 96, as shown for slot 94 further has a rear terminal closed end portion 104 for limiting the distance which the ink fountain can be moved forward or toward roll 30.

As shown in FIG. 3, adjacent a rear portion of and laterally outwardly extending from side member 60 is an ink fountain retaining means, that includes a bracket 106. Similarly, adjacent a rear portion of and laterally outwardly extending from side member 62 is an ink fountain retaining means, that includes a bracket 108. Each of the brackets 106 and 108 are affixed to the ink fountain assembly 40. As best shown in FIG. 4 for bracket 106, each of the brackets has a fastener receiving means, such as the laterally accessible opening 110 adapted to receive a retaining member, such as the pivot mounted retaining bolts 112 and 114 pivotally attached to ink fountain support assembly 42 (shown in FIG. 2).

Figure 8:
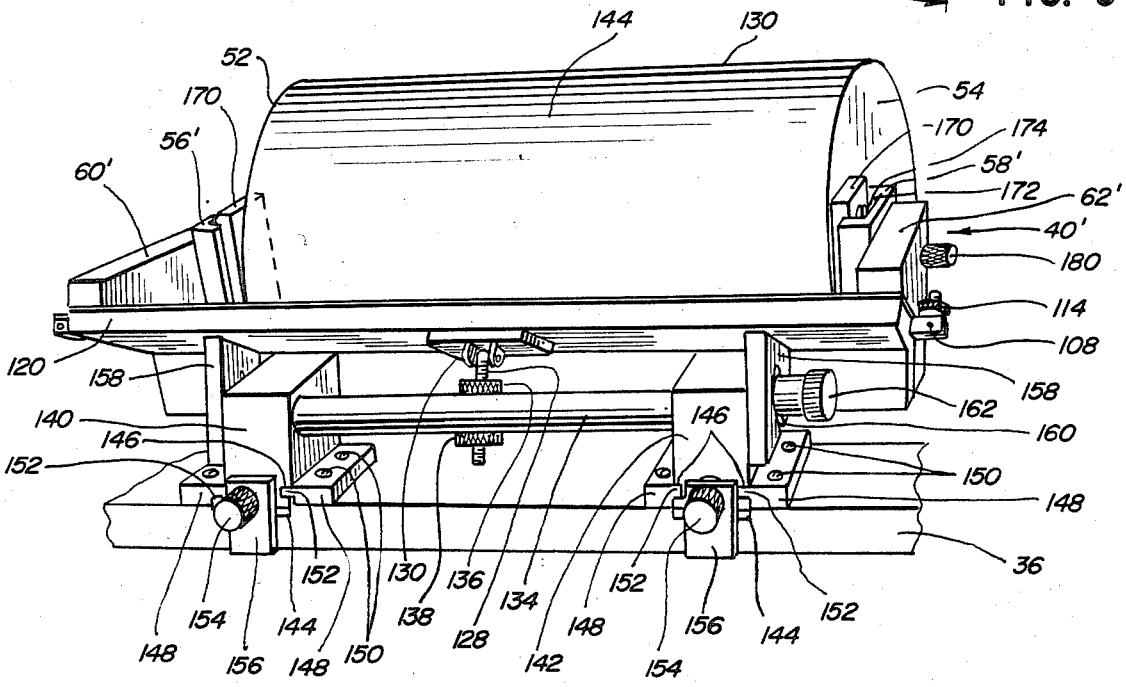
FIG. 8 is a rear perspective view, showing an ink fountain having the structure shown in FIG. 6 removably engaged with the support structure shown in FIG. 7.

As shown in FIGS. 2 and 3, and better shown in FIG. 8, an adjustable angular support means, such as the threaded member 128, is pivotally engaged with a lower portion of support plate 120 by appropriate means, such as the bracket 130 and pivot pin 132.

Member 128 extends longitudinally downward and passes through an opening in a mounting shaft 134. A pair of position retaining adjustment means, such as the knurled nuts 136 and 138 are positioned respectively on an upper and a lower side of shaft 134. Nuts 136 and 138 are threadly engaged with threaded member 128 to enable selective manual adjustment and fixed positioning of support plate 120 with respect to the shaft 134. The support shaft 134 is supportedly mounted for rotation about its own longitudinal axis by appropriate support means such as a pair of laterally spaced lineally slidable support blocks 140 and 142.

Each of the support blocks 140 and 142, as illustrated in FIG. 3, and as best shown in FIG. 8, is mounted for sliding lineal movement toward and away from surface 44 of roll 30 by being mounted in appropriate lineal guiding means formed in, or affixed with respect to, a portion of frame means 36, such as the pair of guide slots 144. Each block 140 and 142 has a lower portion which is received for lineal sliding motion in one of the guide slots 144. Blocks 140 and 142 each have a pair of retaining slots 146 on each of their lateral sides. A pair of retaining plates 148 are affixed to, or with respect to, frame means 36 by appropriate means, such as by threaded fasteners 150. As shown in FIG. 8 a retaining plate 148 is positioned on each lateral side of a mounting block 140 and 142. Each retaining plate 148 has a laterally inwardly projecting guide and retaining shoulder 152 which is sized and positioned to be received in a guide and retaining slot 146 formed at each lateral side of the blocks 140 and 142. Thus each of the blocks 140 and 142 are mounted with respect to, or on, frame means 36 to be slidably moved in a direction substantially normal to the longitudinal axis of roll 30 toward and away from surface 44 of roll 30.

A position adjustment means, such as a pair of adjusting bolts 154 are threadedly engaged within each of the blocks 140 and 142. A pair of retaining brackets 156 are mountedly affixed on, or with respect to, frame means 36. Each bracket 156 has a slot which receives a bolt 154 for enabling the bolt to be rotated with respect to the bracket, but prevents longitudinal movement of the bolt with respect to the bracket. Each of the adjusting bolts 154 is preferably provided, as shown in FIG. 8, with a knurled, finger graspable head to enable convenient manual adjustment of support blocks 140 and 142, support plate 120 and the ink retaining receptacle or fountain, such as fountain assembly 40, supportedly engaged with support plate 120. Rotation of bolts 154 in a selected direction causes movement of blocks 140 and 142 toward or away from surface 44 to selectively control the amount of pressure with which end portion 76 of the doctor blade 70 engages or contacts surface 44, as best shown in FIG. 2.

Also, as best shown in FIG. 2, manual manipulation of knurled nuts 136 and 138 causes longitudinal up or down movement of threaded support member 128 with respect to the opening through which member 128 extends in support shaft 134. Movement of angular adjustment member 128 causes support plate 120 to correspondingly move vertically. Thus an ink receptacle, such as the ink fountain assembly 40 is caused to pivot about its forward pivot means, such as pivot pins 98 and 100 in slots 94 and 96, to change the angle at which the edge portion 76 of the doctor blade 70 contacts surface 44 of roll 30.

As shown in FIG. 8, a position assuring means, such as a pair of plates 158 are provided to assure that support plate 120 and assembly 40 move horizontally with blocks 140 and 142. Plates 158 also serve to assure that nuts 136 and 138 do not "travel" on member 128 during operation of the press and thus undesirably change the relative angle of contact between roll 30 and ink fountain 40. Each member 158 is affixed at an upper portion to a lower surface of support plate 120 and depends downwardly to be laterally positioned outward of blocks 140 and 142. A locking slot 160 is provided in each plate 158 and a locking means, such as a set screw 162 extends through the locking slot 160 into the respective block 140 or 142, the member is positioned immediately outward of. When the desired angular setting has been achieved using threaded member 128 and nuts 136 and 138 the screws 162 can be torqued into a respective block 140 or 142 to lockingly frictionally engage the member 158 to a block to assure no inadvertant or unintentional movement of ink fountain 40 with respect to frame 36 can occur.

Figure 7:
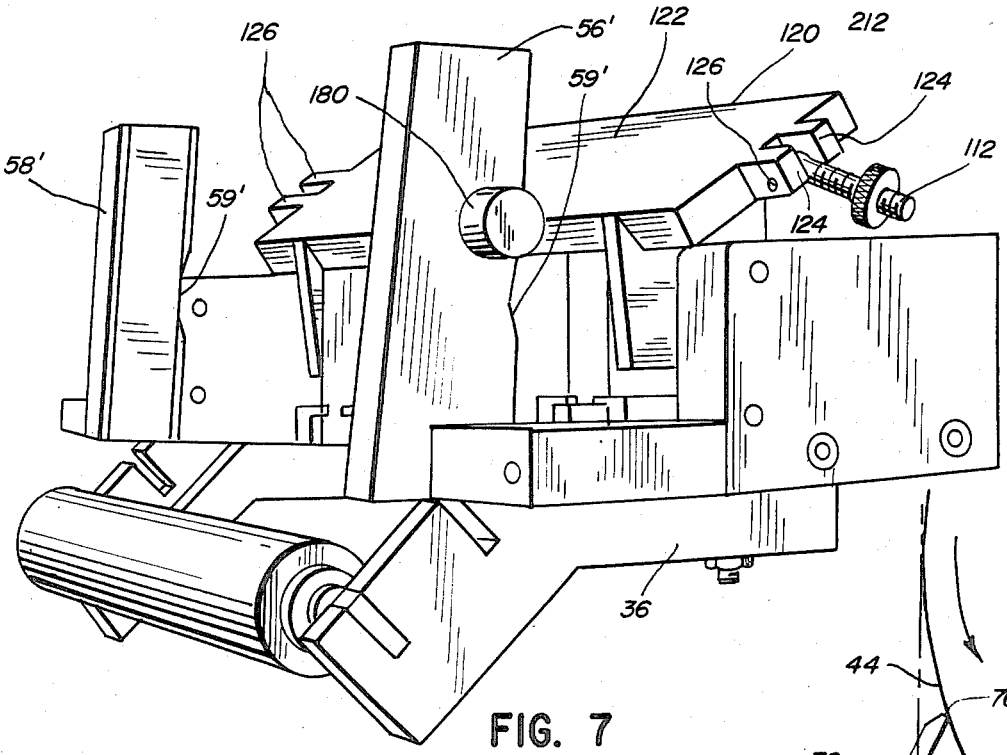
FIG. 7 is a side perspective view of an alternate embodiment of an ink fountain support structure of this invention, particularly one for receiving an ink fountain having the structure shown in FIG. 6.

FIGS. 6, 7 and 8 illustrate an alternate emodiment 40′ of an ink fountain of this invention.

As shown in FIGS. 7 and 8, in this embodiment 40′ the pivot brackets 56′ and 58′ are affixed to the frame means 36 laterally inward of the respective sides 60′ and 62′ of the ink fountain 40′. As best shown in FIG. 8, in this embodiment each of the pivot brackets 56′ and 58′ retainingly engaged an ink seal or dam means, such as the dam members 170. Members 170 are retained engaged with the brackets 56′ and 58′ by appropriate slots 172. An appropriate biasing means, such as one or more helical springs 174, may be used to urge a sealing surface of each block into an end surface 52 or 54 of the roll 30 substantially as shown for block 170 engaged with pivot bracket 58′ in FIG. 8. Dam members 170 may be formed of substantially rigid, long wearing and durable metal or plastic materials and may be coated or impregnated with a friction reducing material, such as tetrafluoethylene. Alternatively, relatively inexpensive, disposable and replaceable dam members similar to the inherently resilient dam members 84 used for ink fountain assembly 40 may be used. In this arrangement the springs 174 would normally be eliminated and the dam member would be slidably inserted longitudinally into the slot in a slight compression fit between the rear surface of the slot and the side surface of roll 30. Also, due to the position of the doctor blade to the rear of, or behind, the dam members, as shown in FIG. 6, a doctor blade receiving slot is not required for dam members 170 used in the ink fountain embodiment 40′. However, in the brackets 56′ and 58′ a doctor blade receiving relief 59′ seen in FIG. 7, is provided to provide sealing engagement between the doctor blade and the brackets.

As best shown in FIG. 6 for the side member 60′ of the ink fountain embodiment 40′, each side member is provided with an elongated pivot member receiving slot 94′ located at the frontal end portion of each side member. Each slot 94′ is provided with a front open end 102′ and a rear terminal closed end 104′.

Affixed to each pivot bracket 56′ and 58′ is, as shown for bracket 56′ in FIG. 6, a laterally outward extending pivot pin 98′ positioned and sized to slidingly receive ink fountain assembly 40′ by being engaged with slot 94′. A retaining bolt 180 may be threadly engageable with pivot pin 98′ whereby the bolt may be used to frictionally engage the side 60′ to the bracket 56′ to maintain ink fountain 40′ in a desired preset position. Alternatively, the bolt 180 may be directly threadedly engaged with bracket 56′ and serve as the pivot pin as well as the position retaining or assuring member.

As shown in FIG. 2, one or more ink splitting or milling rolls or rollers, such as the pair of rolls 190 and 192, may be resiliently engaged with frame means 36 and rollingly engaged with surface 44 of roll 30, substantially as shown, to aid in distributing ink over the surface 44 in a consistent, uniform manner. Rolls 190 and 192 may be of the linear oscillating type which iniformly shuttle back and forth along their longitudinal axis as they rotate.

Figure 10:
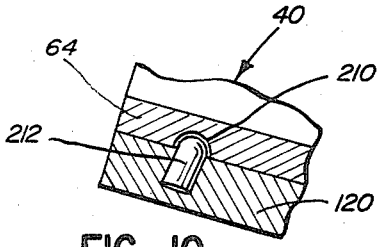
FIG. 10 is a partial view, in cross section, of a fragment of the structure shown in FIG. 3, as indicated by the section line 10—10 in FIG. 3, showing position locating structure located on each the adjustable support assembly and the ink fountain assembly.

FIG. 10 is a partial view, in cross-section, of FIG. 3 as indicated by the section line 10—10, showing a fountain position locating means to assure accurate positioning of assembly 40 with respect to support plate 120 of support assembly 42. An appropriate position locating means is comprised of a depression or recess 210 formed in the lower surface of bottom member 64 and a protrusion 212 which extends upward from plate 120. Protrusion 212 is sized and positioned to fit tightly, but easily, within recess or depression 210. As best shown in FIG. 3, preferably a pair of such recesses 210 and protrusions 212 are provided to enable return of assembly 40 to a precise location with respect to plate 120 of support assembly 42. As an optional construction the recess may be formed in support plate 120 and the protrusion would then be affixed to and depend from bottom member 64.

Having described above the structural elements of this invention and the functional relationship of the elements with respect to adjacent or coacting elements, the operation and advantages of this invention will now be described.

Referring to FIG. 2, during normal operation of printing press 12 the ink carrying form roll 30, which may be of any of a variety of commercially available and widely used form roll constructions, including an anilox type roll having a surface 44 having a multiplicity of ink carrying impressions or indentations formed in surface 44, rotates, as indicated by the arrow, in a counterclockwise direction.

A quantity of ink contained within ink well 116 of ink fountain 40 must be sufficient to place the ink level L at least above the upper surface portion 76 of the doctor blade 70 to expose a quantity of ink sealingly entrapped within the well 116 to surface 44 of roll 30, substantially as shown in FIG. 2. Thus, as surface 44 rotates downwardly with respect to the ink pool retained in part by and contacting surface 44, a quantity of ink is deposited on, or picked up by, surface 44. Precisely at the point where the upper portion 76 of doctor blade 70 is positioned with respect to surface 44 from end surface 52 to end surface 54 of roll 30 a portion of the ink picked up by surface 44 is sheared off by the upper surface or portion 76 and remains in the ink pool 116. A precisely metered quantity of ink is allowed to remain on surface 44 and is carried downward to be split or futher distributed and worked on surface 44 by oscillating rolls 190 and 192. Surface 44 carries this film of ink to a printing plate 200 having a desired ink pick up design or pattern on it. The film of ink is transferred to plate 200, which is affixed to plate roll 32 and rotates, as indicated by the arrow, in a clockwise direction about journaled shaft 48. Inked plate 200 is rotated into engagement with the upper surface of strip 24 as it moves over the outer, back up or paper strip support surface of the counterclockwise rotating impression roll 34 rotating on or with journaled shaft 50. The ink carried by the plate 200 is transferred to the strip 24 and strip 24 then continues lineal movement to either cutting or winding equipment if a single color design is being printed, or to one or more other printing units, such as units 14, 16 et cetera, to have addition material printed on it in other colors of ink placed in the ink wells of those printing units. Rolls 30, 32 and 34 may be driven by any of a variety of commercially available and currently widely used drive systems to rotate the rolls at substantially the same, or desired other, surface speeds with respect to each other.

In current commercial printing, whether using a single unit 12 or a plurality of units as shown in FIG. 1, the ability to print high volume long runs or low volume short runs of printed materials is vitally important. For a series of low volume short runs of different designs, the great time required to change the plates 200 and particularly to clean out the previously used ink from each ink fountain, clean the dam members at each side of the roll 30 and refill the ink fountain with a quantity of another ink to be used for the next run is non-productive. An additional economic penalty is often incurred because a substantial quantity of ink must be placed in the ink fountain to contact the form roll and, at the end of a short run, returned to a storage vessel or disposed of during clean up of the ink fountain.

Lastly, the relationship of the ink fountain and the form roll typically must be adjusted at each printing unit to acheive optimum printing quality. Such adjustments are generally accomplished during a time consuming, nonproductive trial run of the new design.

Using the self-contained ink fountain 40 of this invention, as best shown in FIGS. 2, 3 and 4, the ink fountain assembly 40 can be removed from the press by loosening and pivoting outward the position retaining bolts 112 and 114 to clear position locating brackets 106 and 108, respectively. Ink fountain 40 may then be manually grasped and its rear portion lifted slightly off support plate 120. Rearward movement of assembly 40 away from roll 30 may then be accomplished to cause the frontal portion of each side member 60 and 62 to slidably move toward disengagemet from the pivot pins 98 and 100 of brackets 56 and 58, respectively. When fountain assembly 40 is pulled sufficiently rearward the open 102 frontal ends of the slots 94 and 96 clear pins 98 and 100, respectively, and the assembly 30 may be lifted upward clear of roll 30 and support structure 42. Assembly 30 may then be taken to an appropriate cleaning facility where the dam members 84 may be removed from the slots 80 and 82 and the remaining ink can be removed from the inside surfaces.

Upon completion of sufficient cleaning of ink fountain 40 a new pair of dam members 84 may be inserted in slots 80 and 82. Ink fountain is then returned to the press. The dam members are aligned with the surface ends 52 and 54 of roll 30 and the open ends 102 of the slots 94 and 96 are aligned to slidably receive respective pivot pins 98 and 100. Sliding ink fountain 40 forward to roll 30 and seating the rear portion on support plate 120 enables alignment of the brackets 106 and 108 with the laterally pivotal retaining bolts 112 and 114 pivotally engaged with support plates 120.

Alignment of the bolts 112 and 114 and the brackets 106 and 108 assures that upper portion 76 of the doctor blade 70 is in precisely the same relationship with respect to surface 44 of roll 30 that it occupied prior to removal of ink fountain 40. Thus, tightening bolts 112 and 114 into engagement with brackets 106 and 108 serves to maintain that operative position and no adjustment of the adjustable ink fountain support means 42 is necessary.

Removal and replacement of an alternate ink fountain embodiment 40′ would involve substantially the identical procedure described immediately above for assembly 40 except normally non-disposable dam members 170 would need to be cleaned at the machine or, if disposable dam members similar to dam members 84 were used, they would have to be replaced at the machine and not at a remote cleaning facility.

The relatively small capacity ink well portion 116 of either assembly 40 or 40′ enables a relatively small quantity of ink to raise the level of the ink to an operative level above upper surface 76 of the doctor blade 70. Therefore, for short or low volume runs requiring a small amount of ink for the actual printing, a lesser quantity of ink remains upon completion of the run. Thus, less ink is liable to be disposed of or, alternatively, require return to a storage vessel. Additionally, primarily just the forward portion of assembly 40 would need cleaning and thus require less cleaning time. Also, the ink fountain when filled to capacity to a level which would substantially cover the upper bottom member 64, holds sufficient ink to preclude the need for frequent replenishment during a long or high volume printing run.

The above described procedure for efficient removal and replacement of ink fountain assembly 40 or 40' also serves well for maintenance during a long run. For example, if a doctor blade 70, due to defect, excessive wear or breakage, needs to be replaced during a printing run the ink fountain is removed from the machine and the fasteners 74 are loosened to disengage retaining bar 72 from retaining engagement with the old doctor blade. The dam members 84 are removed to allow removal of the doctor blade 70 and replacement of the blade with a like blade of standard dimensions. The new blade is placed into proper engagement with the ink fountain. The same dam members are replaced in their slots and, by alignment of members 210 and 212, the ink fountain is replaced in the machine or press in exactly the same position it was removed from, to enable the press to be substantially immediately operable without adjustment of structure 42.

Adjustment of structure 42 to change either the pressure with which contact portion 76 of the doctor blade 70 engages the ink carrying surface of roll 30 or the angle at which the portion 76 intersects surface 44 is typically done during inital set up of a printing run or to improve or restore the printing quality during a run.

Figure 9:
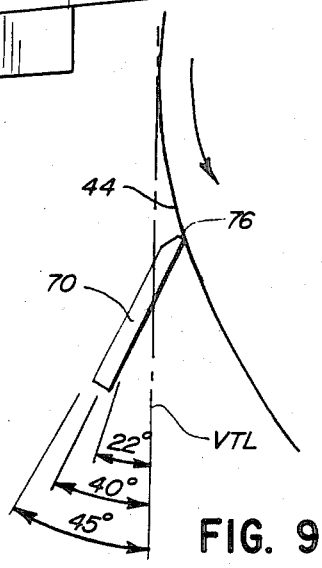
FIG. 9 is an enlarged diagrammatic side elevation view showing a doctor blade having the typical cross-sectional configuration disposed herein and shown placed in operative engagement attitude with an ink carrying surface of an ink transfer roll.

As shown for doctor blade 70 in FIG. 2 and better shown in FIG. 9, the typical preferred position of blade 70 with respect to surface 44 is to have the upper terminal end 76 in contact with surface 44 with sufficient pressure to maintain the contact without deflecting or bending the blade along its lateral dimension normal to the longitudinal axis of roll 30. Insufficient pressure or engagement, as well as excess, deflecting pressure typically causes too little ink to be removed from the surface 44 by the doctor blade 70. In other words, either too much or too little pressure tends to enable an undesirably excess coating of ink to be carried downward away from the ink fountain to be transferred to the plate 200. As best seen in FIG. 2, turning each of the adjustment bolts 154 in a first direction, such as clockwise, forces adjustment structure 42 and, of course, ink fountain assembly 40 inward toward roll 30 to increase the contact pressure between doctor blade contact portion 76 and surface 44. Turning the adjusting bolts 154 in the opposite direction moves the doctor blade portion 76 away from surface 44 to reduce the pressure. Thus, adjustment of finger turnable bolts 154 enables convenient accurate adjustment of the pressure with which the doctor blade engages surface 44 across the complete width of surface 44 from terminal end 52 to terminal end 54 of roll 30. As the blade 70 extends beyond each end 52 and 54 into the dam members 84 no bead or buildup of ink is permitted on surface 44 adjacent either of the ends 52 and 54.

Adjustment of the angle with which the end surface 76 of blade 70 engages the surface increases or decreases the amount of ink which the doctor blade allows to remain on the surface 44. A commercially available doctor blade 70 having a cross-sectional configuration as shown in FIG. 9, is for the ink assembly 40 of FIG. 2, adjustable, with respect to a vertical tangent line VTL, to intersect line VTL at a range of angles of from about 22° to about 45°. For typical operation of a press unit having the ink fountain of this invention the angle which often provides best results is about 40°.

As ink fountain angular adjustment screw 128 is moved from one end of its adjustment to the other. Therefore, the angle with which the doctor blade intersects a line VTL will range from about 22° to about 45° and within this range the pressure with which end 76 of blade 70 contacts surface 44 will remain substantially constant, or the same. At an angle of 45° of the doctor blade to the VTL of surface 44 the least amount of ink will be carried away from ink fountain 40. At an intersecting angle of 22° the greatest amount of ink will be carried away from the ink fountain by the ink carrying surface 44. Thus, by manual adjustment of the pressure and intersecting angle using respectively adjusting nuts 136 and 138 and angular adjustment member 128 the doctor blade 70 can be readily positioned at optimal engagement with surface 44 to provide the desired quality of printing and the optimum position or relationship of the doctor blade can be preserved or returned to when the ink fountain is removed from the press for repair or cleaning and color change and returned to the press.

While particular embodiments of this invention have been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. In a printing press having a frame and a substantially cylindrical form roll having a first end and a second end and a radially outward facing ink-carrying surface extending between said ends mounted for rotation on said frame, said press having an ink fountain having a front portion having a doctor blade for contacting said ink-carrying surface and a rear portion spaced from said front portion, an improved ink fountain support structure comprising, in combination:

first support means for removably engaging said front portion of said ink fountain for enabling said doctor blade to be moved toward and away from said ink carrying surface and to be moved horizontally with respect to said ink carrying surface, including a pair of pivot brackets affixed to said frame and said front portion being slidably movable into and out of engagement with said pivot brackets and mounted for pivotal movement with respect to said brackets; and second support means for adjustably and rigidly supporting said rear portion of said ink fountain with respect to said first support means, for maintaining said doctor blade in a desired position with respect to said ink carrying surface and for selectively changing the position of said doctor blade with respect to the ink carrying surface.

2. The invention defined in claim 1 together with means for disengaging said ink fountain from each said second support means and said first support means and returning said ink fountain to said first support means and said second support means for returning said doctor blade to its predisengagement position with respect to said ink carrying surface whereby said ink fountain may be removed from an operative position in said press and serviced and returned to said same operative position in said press.

3. The invention defined in claim 1 in which each of said pivot brackets includes a laterally extending pivot pin and said front portion of said ink fountain includes a pair of longitudinally extending slots and said pivot pins are slidably received in said slots.

4. The invention defined in claim 1 together with slidable seal means for sealing said front portion of said ink fountain to said form roll.

5. The invention defined in claim 1 in which said front portion of said ink fountain is positioned laterally outward of each said first end and said second end of said form roll and said doctor blade extends from completely across said front portion of said ink fountain for establishing line contact engagement with said ink carrying surface from said first end to said second end of said form roll.

6. The invention defined in claim 1 in which said second support means is comprised of a horizontally adjustable means engaged for sliding lineal movement toward and away from said form roll and a substantially vertically adjustable means operatively engaged with said horizontally adjustable means for adjusting said doctor blade with respect to said ink-carrying surface of said form roll.

7. The invention defined in claim 6 in which said horizontally adjustable means includes a pair of adjustment members slidably engaged with said frame of said press.

8. The invention defined in claim 7 in which said vertically adjustable means includes a threaded member operatively engaged with a support member extending between and supported by said pair of adjustment members.

9. The invention defined in claim 2 in which said disengaging means is comprised of a pair of brackets on said ink fountain and a pair of pivot bolts on said second support means and a locating recess on said ink fountain is occupied by a protrusion on said second support means whereby said bolts are engaged with said brackets for retaining said desired position.

10. An ink receptacle for supplying ink to an ink-carrying roll of a printing press, said ink-carrying roll having a longitudinal axis, said ink receptacle comprising, in combination:

a pair of radially extending, side wall members longitudinally spaced from each other, each of said side members having a front portion and a back portion;

means forming a bottom for said receptacle, said bottom means extending between said side wall members and being sealingly engaged with said side wall members; said bottom means having a forward portion and a rearward portion and a substantially vertical wall portion positioned in engagement with said forward portion;

doctor blade means extending longitudinally between said front portions of said pair of side members, said doctor blade means being sealingly engaged with said forward portion of said bottom means and extending upwardly and inclined forwardly from said bottom means for forming a front wall of said ink receptacle for providing a small-volume ink well between said substantially vertical portion of said bottom means and said doctor blade means;

means sealingly engaging said doctor blade means to said front portions of each of said side members for maintaining a pool of ink in said small-volume ink well of said ink receptacle; and means for selectively adjusting said doctor blade means, said means being operatively connected to the rearward portion of the ink receptacle.

11. The ink receptacle as set out in claim 10 in which said sealing means is comprised of molded plastic resilient pads.

12. The ink receptacle as set out in claim 11 in which said front portion of each of said side members adjacent said doctor blade means includes a retaining slot and one of said resilient pads is compressively sealingly retained in said slot and sealingly engaged with a portion of said doctor blade means.

13. In a printing press having frame means and a substantially cylindrical form roll mounted for rotation on said frame means, said form roll having a radially outward facing, ink-carrying surface, said press further including ink receptacle means, said ink receptacle means being bounded by a doctor blade for removing excess ink from said ink-carrying surface of the form roll, said doctor blade being angled so that the edge of the blade points in a direction opposite to the rotational direction of said from roll and contacting said ink-carrying surface at a point just below the intersection of said ink-carrying surface of the form roll and a vertical line tangent to said ink-carrying surface;

an improved ink receptacle support structure comprising, in combination:

a front portion of said ink receptacle support structure being located proximate to said doctor blade and spaced between the ink-carrying surface of the form roll and the axis of the form roll, so that one upright boundary of the ink receptacle is located radially inwardly of the surface of the form roll;

a rear portion of said ink receptacle support structure being located radially outwardly of the front portion of the support structure and spaced outwardly of the form roll; screw means spaced outwardly of the form roll and engaging said rear portion of said ink receptacle to provide a means for selectively adjusting the angle at which said doctor blade contacts said ink-carrying surface; and means for selectively adjusting the pressure at which said doctor blade contacts said ink-carrying surface of the form roll.

14. The printing press of claim 13 in which said form roll includes a longitudinal axos and a pair of longitudinally spaced end surfaces positioned substantially normal to said longitudinal axis.

15. The printing press of claim 14 in which said front portion of said ink receptacle support structure includes a pair of front engagement elements longitudinally spaced from each other, each of said front engagement elements being constructed and arranged to be longitudinally outwardly spaced axially from one of said spaced end surfaces of said form roll.

16. The printing press of claim 15 in which each of said front engagement elements includes an engagement means for being removably pivotally mounted to said frame.

17. The printing press of claim 14 in which said ink receptacle includes a bottom member having a sloped portion and a vertical portion.

18. The printing press of claim 17 in which said vertical portion of said ink receptacle is spaced from said doctor blade in a direction away from said form roll, for forming a small volume ink well having a front wall defined by said doctor blade.

19. The printing press of claim 18 in which said ink well includes seal means adapted for sealingly engaging each of said doctor blade, a portion of said ink well, a portion of said ink receptacle and said pair of end surfaces of said form roll, for maintaining a pool of ink in said ink well.

* * * * *